US006900626B2

(12) United States Patent
Pröll et al.

(10) Patent No.: US 6,900,626 B2
(45) Date of Patent: May 31, 2005

(54) VOLTAGE GENERATOR ARRANGEMENT

(75) Inventors: Manfred Pröll, Dorfen (DE); Ralf Schneider, München (DE); Stephan Schröder, München (DE); Joerg Vollrath, Olching (DE)

(73) Assignee: Infineon Technologies, AG (DE)

( * ) Notice: Subject to any disclaimer, the term of this patent is extended or adjusted under 35 U.S.C. 154(b) by 0 days.

(21) Appl. No.: 10/736,506

(22) Filed: Dec. 17, 2003

(65) Prior Publication Data

US 2004/0124824 A1 Jul. 1, 2004

(30) Foreign Application Priority Data

Dec. 17, 2002 (DE) ..... 102 59 054

(51) Int. Cl.[7] ..... G05F 3/08
(52) U.S. Cl. ..... 323/312; 327/539
(58) Field of Search ..... 323/312, 313, 323/314; 327/538, 539, 530

(56) References Cited

U.S. PATENT DOCUMENTS 4,804,904 A * 2/1989 Katakura ..... 327/552
5,287,054 A * 2/1994 Llewellyn ..... 327/538

* cited by examiner

*Primary Examiner*—Shawn Riley
(74) *Attorney, Agent, or Firm*—Edell, Shapiro & Finnan, LLC

(57) ABSTRACT

A voltage generator arrangement supplies a largely constant output voltage with a high current driver capability. A bandgap reference circuit is downstream from an impedance converter and downstream a voltage generator. The bandgap reference circuit and the impedance converter on the one hand and the voltage generator on the other hand are connected to different reference ground potential line. The impedance converter contains a charge pump circuit to provide increased control potential, which drives the voltage generator. The voltage generator in contrast produces a reduced output potential. The influence of any voltage drop on that reference ground potential line to which the voltage generator is connected in the output potential is thus likewise reduced.

10 Claims, 2 Drawing Sheets

VOLTAGE GENERATOR ARRANGEMENT

CROSS-REFERENCE TO RELATED APPLICATION

This application claims priority under 35 USC §119 to German Application No. 10259054.0, filed on Dec. 17, 2002, and titled "Voltage Generator Arrangement," the entire contents of which are hereby incorporated by reference.

FIELD OF THE INVENTION

The invention relates to a voltage generator arrangement, and more particularly, to a voltage generator arrangement suitable for integration in a semiconductor chip that produces a constant output voltage for driving and supplying functional units.

BACKGROUND

A large number of internal voltages of different magnitude are required in integrated semiconductor circuits, for example, in dynamic semiconductor memory modules, so-called DRAMs, in order to supply the internal functional units and to operate them correctly. The output voltage must be as constant as possible and must be provided with adequate current driver capability, with as low an impedance as possible.

As is known, a DRAM comprises memory cells with a storage capacitor, whose state of charge represents the stored information. Due to leakage currents, the stored charge state in the capacitor is changed, and the separation from a reference decreases. In order to make it possible to read the stored information without any errors despite this, it is necessary for the reference levels to be used to be as constant as possible and to maintain a predetermined level of magnitude, even in poor operating states. For example, a voltage generator is required which is located precisely centrally between the voltage levels that represent the two binary logic states. Since the information to be read is compared with this central voltage level, its accuracy is subject to relatively stringent requirements. Finally, further potentials, which supply the memory cell array and the circuits for reading and writing are also provided by a higher-level voltage generator arrangement.

A voltage generator arrangement such as this comprises two or more stages. A bandgap reference circuit provides an output potential, which is referred to as reference ground potential and is largely independent of external operating influences, such as the external supply voltage or temperature. The bandgap reference circuit has a high-impedance output. The bandgap reference circuit is thus expediently followed on the output side by an impedance converter, which transforms the reference potential, that is provided with a high impedance, to a low impedance. Finally, the impedance converter drives a voltage generator, which is arranged on the output side and supplies an output potential that is relatively constant and has a high current driver capability, and whose magnitude is set as a function of the output signal from the impedance converter. Two or more impedance converters may be driven in parallel by the same bandgap reference circuit, or various output-side voltage generators may be provided in order to produce different output voltages, or the same voltages, which can be fed in at different points on the semiconductor chip.

In the case of a voltage generator arrangement such as this, it has been found to be expedient to provide separate reference ground potential lines. In this case, the bandgap reference circuit and the impedance converter are connected to a first reference ground potential line. The bandgap reference circuit and the impedance converter draw a constant current irrespective of the various operating states of the DRAM. Furthermore, the current that is drawn is relatively small. The voltage drop along this line is thus constant, or can easily be compensated for. The output-side voltage generator is connected to a second reference ground potential line, which is separate from the first. The two reference ground potential lines are, for example, formed from metal tracks which run in a metallization plane on the semiconductor chip and which, for example, are composed of aluminum or of an aluminum alloy. The reference ground potential is supplied from the exterior via what is referred to as a connecting pad. Various pads are also feasible, which are then connected to one another externally to the chip. The two reference ground potential lines are typically connected via the connecting pad at least to the external supply for the reference ground potential.

Since the current, which is not inconsiderable during operation, is supplied via the external voltage generator to a load that is to be driven, and this current flows back via the second reference ground potential line to the connecting pad, in which case the current that is drawn can also fluctuate relatively severely as a function of the operating states of the DRAM, the voltage drop along the second reference ground potential line is no longer negligible. A voltage drop is thus produced between the connecting pad and that point at which the output-side voltage generator makes contact with the second reference ground potential line. This voltage drop can fluctuate over time.

The described voltage generator arrangement is thus subject to the problem that the reference generator and the impedance converter are always supplied with a constant reference ground potential, while the potential at the reference ground potential connection for the output-side voltage generator fluctuates as a function of the current flowing via the second reference ground potential line. Thus, during operation, the reference ground potentials for the output-side voltage generator on the one hand and for the bandgap reference circuit and the impedance converter on the other hand differ from one another. Until now, the output-side voltage generator has raised the reference voltage that is supplied from the impedance converter to a higher voltage level. For example, the bandgap reference circuit produces an output voltage of 1.2 V, and the impedance converter produces an output voltage of 1.6 V. The latter output voltage is raised by the output-side voltage generator to, for example, 2.0 V. The output-side voltage generator thus amplifies the voltage drop that occurs on the second reference ground potential line and, in consequence, amplifies the voltage error within the output voltage that is to be produced.

In particular, as miniaturization of the structures on the integrated semiconductor chip progresses and as complexity of the circuits to be supplied increases, there is a trend on the one hand to reduce the internal voltages further although, on the other hand, higher currents are required, even though the resistances of the metallization lines increase as a result of the smaller structure widths. The reference ground potential lines are becoming relatively longer with respect to the number of functional units to be supplied, as integration progresses. As a consequence of these boundary conditions, it is problematic to provide the required internal voltages with sufficient constancy and a sufficiently high current drive capability with the use of conventional concepts. The amplification of the parasitic voltage drop along the second reference ground potential line in the output-side voltage generator also results in the output voltage becoming less stable.

SUMMARY

A voltage generator arrangement can produce a sufficiently stable output voltage for a functional unit that is to be supplied in the boundary conditions mentioned above. In particular, the voltage generator can provide an output voltage that is as stable as possible, even in large-scale integrated circuits with relatively small structure widths.

A voltage generator arrangement can include a connection for a supply potential, a connection for a reference ground potential, an output connection for an output potential to be tapped off, a first reference ground potential line which is connected to the connection for the reference ground potential, and a second reference ground potential line, which can be connected to the connection for the reference ground potential, a bandgap reference circuit, which can be connected to the first reference ground potential line and can have an output connection, and an impedance converter circuit, which can be connected between the connection for the supply potential and the first reference ground potential line. The impedance converter circuit can be connected on the input side to the bandgap reference circuit and can have an output connection. A voltage generator can be connected between the connection for the supply potential and the second reference ground potential line. The second reference ground potential line can be connected on the output side to the connection for the output potential to be tapped off, and which, on the input side, can be driven by the output connection of the impedance converter circuit. The impedance converter circuit can produce an output potential, which can be higher than the input potential that is supplied from the bandgap reference circuit. The voltage generator can produce an output potential, which can be lower than the potential that is supplied from the impedance converter circuit.

The voltage generator arrangement according to the invention departs from the previous concept, according to which the potential was raised from the impedance converter stage to the output-side voltage generator. Instead, a sufficiently high output voltage can be produced in the impedance converter stage such that the output-side voltage generator stage can produce a decrease in potential, rather than an increase in potential. The influence of a voltage drop along the second reference ground potential line in the output voltage can be reduced.

In one implementation, in an integrated circuit, a charge pump circuit to be coupled into the signal path in the impedance converter can be provided. A charge pump circuit uses clocked controlled pumping processes to produce an output voltage, which is higher than the input voltage, from a low input voltage. The charge pump circuit can provide that the output voltage, which can be emitted from the impedance converter, can be sufficiently high that the output voltage can be reduced by the output-side voltage generator in order to achieve the desired voltage on the output side. The output connection of the charge pump circuit can be coupled to the input connection of the output-side voltage generator, which can control the magnitude of the output voltage.

According to a first embodiment, the output connection of the charge pump can be connected directly to the control input of the downstream, output-side voltage generator. The increased output voltage from the charge pump circuit can control the output voltage directly. The charge pump is itself driven on its input side by a comparator to which the output voltage for the impedance converter or from the charge pump circuit is fed by a voltage divider. The full voltage of the charge pump can be passed on in this case, so that the downstream voltage generator may have a high potential reduction factor in order to pass on the voltage drop that occurs along the second reference ground potential line in an extremely reduced manner. However, due to the clocked operation, the output voltage produced by the charge pump can have a certain amount of ripple, which may not be regulated out by the completely.

A second embodiment provides for the impedance converter to have a load transistor on the output side, which is driven by a comparator into which the output voltage that is emitted from the impedance converter is fed back. The load current path of the load transistor can be in this case fed with current and supply voltage from the output of the charge pump circuit. The charge pump circuit can be operated on full load, so that the ripple in its output voltage can be reduced by switching-on and off processes that are required for other reasons. Furthermore, the ripple in the output voltage that can be emitted from the impedance converter can be dampened by the control loop within the impedance converter. Overall, the output voltage from the voltage generator arrangement can have a relatively small amount of ripple and can be relatively constant even when the demanded output current is high.

In each embodiment, the output voltage from the impedance converter can be tapped off by a voltage divider that can be connected between the output and the first reference ground potential line, and can be fed back to the respective comparator. However, the input connections of the comparators can be connected differently in the two cases. In the first embodiment, the voltage divider can be fed back to the inverting negative input of the comparator, while in the latter embodiment. The voltage divider can be fed back to the non-inverting positive input.

The output-side voltage generator can be connected to the second reference ground potential line. The bandgap reference circuit and the functional blocks, which can be associated with the impedance converter circuit, can be connected to the first reference ground potential line, in particular, including the charge pump circuit. These circuits, including the charge pump circuit, can draw a constant small current, which can be independent of operating states, so that the voltage drop along the first reference ground potential line can be compensated for and can be ignored bearing in mind the accuracy of analysis.

An embodiment in which a load transistor taps off the load current from the external supply voltage and, controlled by a comparator, passes it to the output connection which produces the internal supply voltage, is recommended for the output-side voltage generator circuit. The output can be fed back directly to the non-inverting positive input of the comparator. The inverting negative input of the comparator can be fed from a voltage divider, which can be driven by the output of the impedance converter. This voltage divider is connected to the second reference ground potential line.

BRIEF DESCRIPTION OF THE DRAWINGS

The invention will be explained in detail in the following text with reference to the exemplary embodiments that are illustrated in the drawing. Identical or corresponding elements in the various figures are provided with the same reference symbols. In the figures.

DETAILED DESCRIPTION

Figure 1:
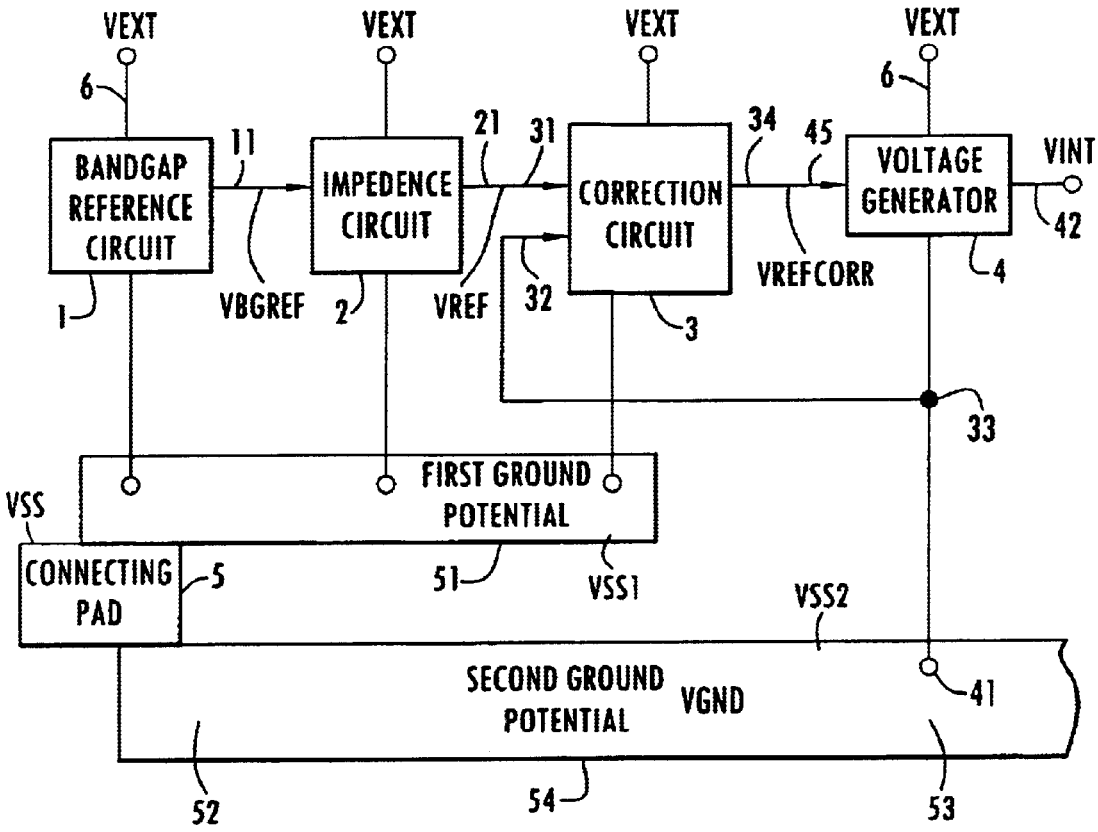
FIG. 1 shows a block diagram of a voltage generator arrangement according to the invention.

Referring to FIG. 1, a voltage generator can produce an internal supply voltage VINT from an externally supplied supply voltage VEXT. Both the voltages VEXT, VINT are related to a reference ground potential VSS. The reference ground potential VSS is, for example, ground. The external supply potential VEXT is supplied with a low impedance to a connection 6 of the integrated circuit, and can be passed to all the stages of the voltage generator arrangement. The reference ground potential VSS can be fed in at the connecting pad 5. The connecting pad 5 can be a metallization surface in the uppermost metallization layer of the semiconductor chip to which the voltage generator arrangement can be fit. A bonding wire can be stamped, or some other conductor track can be pressed onto the connecting pad 5, in order to supply the reference ground potential VSS from the exterior to the chip.

The reference ground potential VSS can be passed on via a first reference ground potential line 51 and via a second reference ground potential line 54 to the functional stages of the illustrated voltage generator arrangement. The first and the second reference ground potential line 51 and 54 can be conductively connected to one another only via the connecting pad 5. The second reference ground potential line 54 can be connected at one end 52 to the connecting pad 5, and can have another end 53, which can be within the circuit.

The voltage generator arrangement can include a bandgap reference circuit 1, which can be supplied on the supply voltage side from the external supply voltage VEXT and which can be connected to the first reference ground potential line 51. A bandgap reference circuit using integrated circuit technology is known. This produces an output voltage of 1.2 V, which can be relatively stable and can be produced independently of the operating temperature and of the applied supply voltage. The output voltage VBGREF can be produced at an output connection 11 of the bandgap reference circuit 1, between the output 11 and the first reference ground potential line 51. The output 11 of the bandgap reference circuit 1 can be connected to an input 22 of an impedance converter 2.

In terms of supply voltage, the impedance converter 2 can be likewise connected between the connection 6 for supplying the external supply potential VEXT and the first reference ground potential line 51. The impedance converter 2 can have an output connection 21, which can convert the high-impedance output 11 of the bandgap reference circuit to a low-impedance signal. A reference potential VREF with respect to the reference ground potential VSS can be produced at the output 21.

Finally, an output-side voltage generator 4 can be provided, can be fed from the external supply potential VEXT (which can be supplied with a low impedance) to the connection 6, and can produce an output potential VINT at an output connection 42. On the reference-ground potential side, the voltage generator 4 can be connected at a point 41 to the second reference ground potential line 54. A large number of functional elements are supplied from the output connection 42 with a voltage that can be as constant as possible between the output connection 42 of the voltage generator 4 and the reference ground potential line 54. The functional elements (which are not illustrated) which are connected between the connection 42 and the reference ground potential line 54, can draw a relatively large current. The current can flow back again to the connecting pad 5 via the second reference ground potential line 54. The magnitude of the level of the potential VINT and of the corresponding voltage, which can be related to the reference ground potential line 54, can be adjusted to be relatively constant by the control signal VREF that can be supplied to the input connection 45 of the voltage generator 4.

The bandgap reference circuit 1 and the impedance converter 2, including the charge pump, can consumes a small and constant current, so that only a small, constant current can flow via the reference ground potential line 51. The voltage which can be dropped along the first reference ground potential line 51 may thus be regarded, with sufficient accuracy for analysis, as zero. The potential VSS1, which exists at points on the reference ground potential line 51, can match the externally supplied reference ground potential VSS. A dynamic current, which fluctuates as a function of operating states and can be essentially used in the load that can be connected to the connection 42 can flow along the second reference ground potential line 54. The voltage drop along the length of the second reference ground potential line 54 can thus no longer be regarded as being negligible. The potential VSS2 which, for example, can be considered at the point 41 at which the voltage generator 4 can be connected to the second reference ground potential line 54, can differ by the voltage VGND from the externally supplied reference ground potential VSS.

The output voltage VREF, which can be produced by the impedance converter circuit 2, can be significantly higher than the output voltage VBGREF of the bandgap reference circuit 1. The output voltage VINT at the connection 42 can be less than the reference voltage VREF. In practice, by way of example, the following relationships can be provided with an acceptable level of circuit complexity:

$$VREF=3.3^* VBGREF$$

$$VINT=0.5^* VREF.$$

Since the potential VINT can be less than the control potential VREF, which can be supplied to the input side of the voltage generator 4, the component of the voltage component VGND along the line 54 between the ends 52, 53 and the contact point 41 can be reduced by the same factor. Load fluctuations, which can produce the voltage drop VGND along the second reference ground potential line 54 due to the different current that can be drawn in the load that can be connected to the connection 42, can be included to a reduced extent in the output voltage. The output voltage can be thus largely constant irrespective of the current drawn in the connected load, and can have a high current driver capability.

Figure 2:
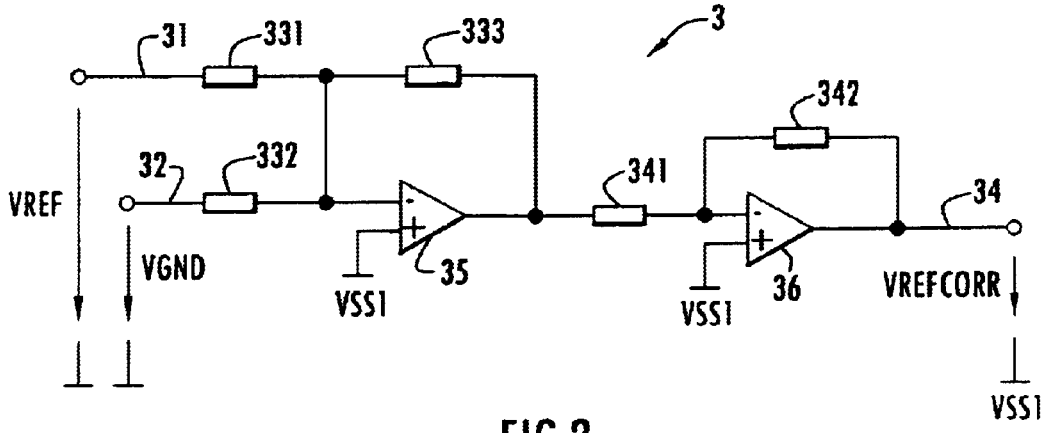
FIG. 2 shows a detailed circuit diagram of an impedance converter circuit according to a first exemplary embodiment.
Figure 3:
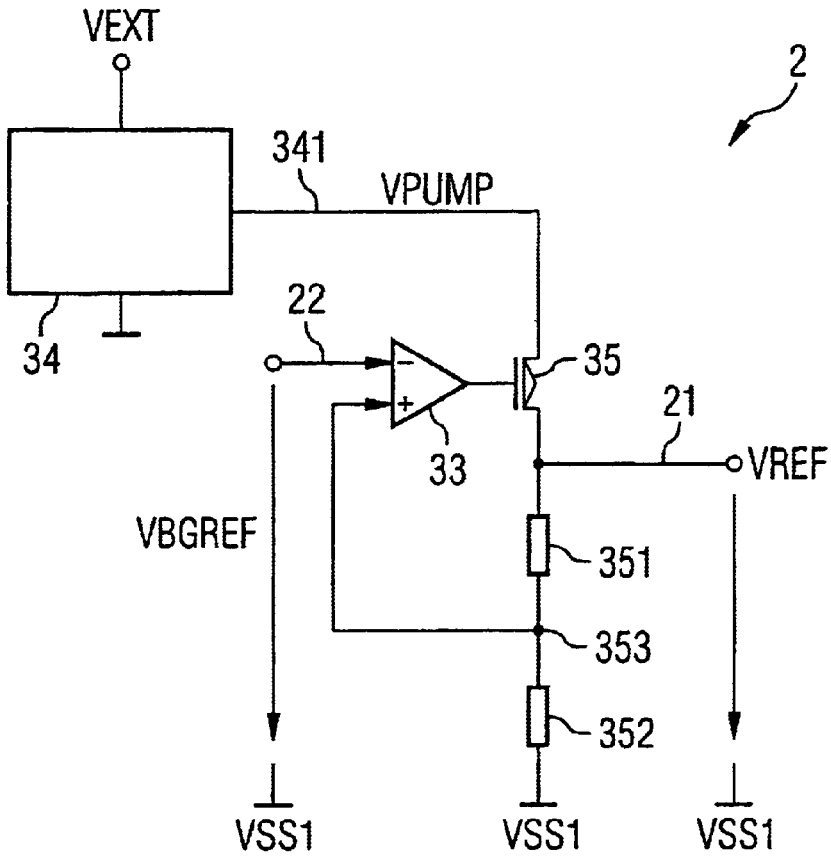
FIG. 3 shows a detailed circuit diagram of an impedance converter circuit according to a second exemplary embodiment.

A charge pump can be required in order to produce the raised voltage VREF, and this charge pump is fed from the external supply potential VEXT and can produce a significantly higher output voltage than the voltage which is supplied to it. Charge pumps are known to those skilled in the art in the relevant field. Change pumps operate on a clocked basis. The charge pumps may operate on a regulated basis, in order to be switched on and off as a function of a control signal, thus resulting in an increased output voltage, which is as constant as possible. Owing to the internal circuit design, a charge pump without a switching-on/off function can operate in saturation and can produce a saturated maximum increased output voltage. The two embodiments, which are shown in FIG. 2 and FIG. 3, may be used as alternatives in order to produce the impedance converter 2 shown in FIG. 1. The embodiments of the impedance converter circuit 2 which are illustrated in FIGS. 2 and 3, can produce an increase in the output potential VREF in comparison to the signal VBGREF that is supplied on the input side, with the input 22 having a high impedance, and the output 21 having a low impedance.

As is shown in FIG. 2, the charge pump 24 can have an output connection 221, which can produce a pump voltage VPUMP related to the reference ground potential VSS1. The output of the charge pump 24 can be connected directly to the output 21, which can be at the reference potential VREF. This potential can be supplied to the voltage generator 4. The magnitude of the control potential VREF can be produced by switching the charge pump 24 on and off by a control signal CTRL at a control input 241 to the charge pump. The control signal CTRL is produced by a comparator 23, which can receive the output voltage VBGREF from the bandgap reference circuit at its non-inverting input 22, and can receive a fed-back signal that has been derived from the output potential VREF at its inverting input 231. For this purpose, the output connection 21 of the impedance converter 2 can be connected via a voltage divider 251, 252 to the reference ground potential line 51 and to the reference ground potential VSS1. The input side of the voltage divider 251, 252 can be formed by the connections 21, 51. The output connection 253, which is formed at the coupling node between the resistors 251, 252, can be fed back to the input connection 231 of the comparator 23. If the output potential VREF from the impedance converter 2 is greater than a switching threshold, this can be signaled to the charge pump 24 by the control signal CTRL, and the pumping process in the charge pump 24 can be switched off. Owing to leakage currents and the current that is drawn, the potential VREF decreases again, so that the control signal CTRL switches on the charge pump again, in order to raise the potential VREF again. The switching threshold is set with respect to the bandgap reference potential VBGREF by using resistors with suitable values in the voltage divider 251, 252.

According to the embodiment shown in FIG. 3, the output potential VREF at the output 21 of the charge pump 2 can be provided by the drain-source path through a p-channel MOS transistor 35. The drain-source path through the transistor 35 can be connected to the output 341 of a charge pump 34. The charge pump 34 can operate, for example, in saturation, and can produce a constant, increased, saturated output voltage VPUMP. A comparator 33 can control the gate connection of the load transistor 35. The inverting input of the comparator 33 can form the input connection 22 of the impedance converter 2, and can be connected to the output 11 of the bandgap reference circuit 1. The non-inverting input of the comparator 33 can receive the output potential that can be fed back via a voltage divider 351, 352. For this purpose, the input side of the voltage divider 351, 352 can be connected between the connection 21 and the first reference ground potential line 51 or the reference ground potential VSS1. The output tap 353 on the voltage divider can be fed back to the non-inverting input of the comparator 33. The load transistor 35 can regulate the output potential VREF from the raised pump voltage VPUMP down as a function of the switching threshold which is defined by the comparator 33, the voltage divider 351, 352 and the bandgap reference potential VGBREF. In comparison to the embodiment illustrated in FIG. 2, the ripple on the output voltage VREF from the circuit shown in FIG. 3 can be damped.

Figure 4:
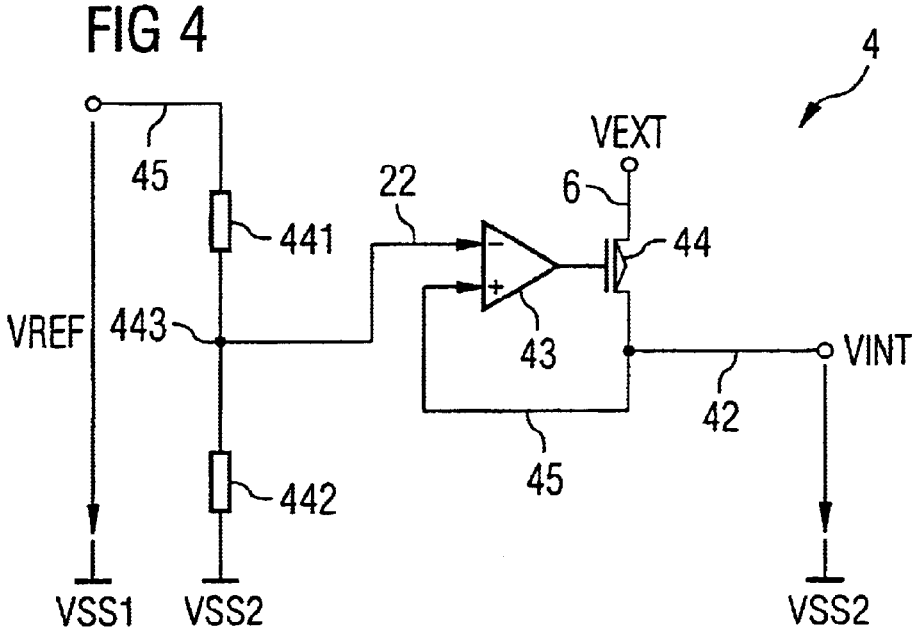
FIG. 4 shows a detailed circuit diagram of an output-side voltage generator for use in the voltage generator arrangement.

Finally, FIG. 4 shows one implementation of the voltage generator 4. The load path or the drain-source current path through a load transistor 44 can be connected between the connection 6 for supplying the external supply potential VEXT and the output connection 42 for the external output potential VINT that is to be regulated. The gate connection of the load transistor 44 can be driven by a comparator 43. The inverting input of the comparator 43 is fed from the output 443 of a voltage divider 441, 442. The input side of the voltage divider 441, 442 can be connected between the input connection 45 of the voltage generator 4 and the connection 41 of the second reference ground potential line 54 or the corresponding reference ground potential VSS2. The non-inverting input of the comparator 43 is expediently short circuited directly via a line 54, and directly to the output 42. The input potential VREF in the circuit in FIG. 4 can be less than the output potential VINT, with the connection 42 having a high current driver capability. The circuit illustrated in FIG. 4 can regulate out fluctuations in the supply potential VEXT by the transistor 44, which can act as a series regulator.

The voltage generator arrangement in FIG. 1 can be used in the field of DRAMS in order to produce the potential VBLEQ, which can be located between for example, in the center between, signal levels which represent a logic "1" (the potential VBLH) and a logic "0" (the potential VSS). Since the signal, which can be read from a memory cells can be compared with the potential VBLEQ, this signal should be as constant a manner as possible, in order to avoid reading errors. If, for example, a logic "1" is written to the memory cell and is then read again or is refreshed again, the potential may be changed along the second reference ground potential line 54 as a result of the load conditions differing in the meantime. In order to make it possible to read reliably, the potentials VBLEQ and VBLH at the times of writing and reading be identical. Furthermore, the voltage generator arrangement can also produce further signals in the DRAM. For this purpose, further impedance converters and output-side voltage generators may be connected in parallel with the output 11 of the bandgap reference circuit, or the control signal VREF for an impedance converter may control two or more voltage generators, comparable to the generator 4.

The details of one or more embodiments are set forth in the accompanying drawings and the description below. Other features will be apparent from the description and drawings and from the claims.

LIST OF REFERENCE SYMBOLS

1 Bandgap reference circuit
2 Impedance converter
3 Correction circuit
4 Voltage generator
5 Connecting pad
6 Connection for the external supply potential
11,21,34,42 Output connections
31, 32, 45 Input connections
35, 36 Operational amplifier
41 Connecting point
43 Comparator
44 Load transistor
451 Tap
51 First reference ground potential line
52 Second reference ground potential line

52, 53 Ends of the second reference ground potential line
452, 453 Resistors for a voltage divider
331,332,333,341,342 Resistors
VEXT External supply potential
VSS Reference ground potential, ground
VSS1, VSS2 Reference ground potential
VGND Reference ground potential difference
VBGREF Bandgap reference potential
VREF Reference signal
VREFCORR Corrector reference signal
VINT Output potential

What is claimed is:

1. A voltage generator arrangement, comprising:

a first connection for a supply potential;

a second connection for a reference ground potential; and a first output connection for an output potential to be tapped off;

a first reference ground potential line, the first reference ground potential line being connected to the second connection;

a second reference ground potential line being connected to the second connection;

a bandgap reference circuit, the bandgap reference circuit being connected to the first reference ground potential line and having an output connection;

an impedance converter circuit, the impedance converter circuit being connected between the first connection and the first reference ground potential line, the impedance converter circuit being connected on the input side to the bandgap reference circuit, the impedance converter circuit being a second output connection;

a voltage generator, the voltage generator being connected between the first connection, and the second reference ground potential line, the second reference ground potential line being connected on the output side to the first output connection to be tapped off, and on the input side, being driven by the second output connection;

the impedance converter circuit further producing an output potential, the output potential being higher than an input potential supplied from the bandgap reference circuit; and the voltage generator producing an output potential, the output voltage generator output potential being lower than the impedance converter output potential supplied from the impedance converter circuit.

2. The voltage generator arrangement as claimed in claim 1, further comprising:

a charge pump circuit, the charge pump circuit being connected between the connection for the supply potential (VEXT) and one of the reference ground potential lines, the charge pump circuit being coupled into the signal path between the bandgap reference circuit and an input connection of the voltage generator.

3. The voltage generator arrangement as claimed in claim 1, wherein the charge pump circuit has an output connection for proving an output potential, the output potential being higher than the input potential; and wherein the output connection of the charge pump circuit is coupled to an input connection of the voltage generator.

4. The voltage generator arrangement as claimed in claim 3, wherein the impedance converter circuit contains a comparator, an input side of the comparator being is connected to the bandgap reference circuit, an output side of the comparator being connected to the control input of the charge pump circuit to control the magnitude of the charge pump output voltage; and wherein the output connection of the charge pump circuit is fed back to the input side of the comparator.

5. The voltage generator arrangement as claimed in claim 4, wherein the impedance converter circuit has a voltage divider, an input side of the impedance converter circuit being connected between the output connection of the impedance converter circuit and the first reference ground potential line and wherein an output connection is connected to an input of the comparator.

6. The voltage generator arrangement as claimed in claim 5, wherein the voltage divider is fed back to an inverting input of the comparator and the bandgap reference circuit is connected to the non-inverting input of the comparator.

7. The voltage generator arrangement as claimed in claim 3, wherein the impedance converter circuit has a comparator, an input side of the impedance converter circuit being connected to the bandgap reference circuit, an output side of the impedance converter circuit controlling a load transistor, wherein a load current path of the load transistor is connected between the output connection of the charge pump circuit and the output circuit of the impedance converter.

8. The voltage generator arrangement as claimed in claim 7, wherein the bandgap reference circuit is connected to an inverting input of the comparator, and wherein the output connection of the impedance converter circuit is fed back via a voltage divider to a non-inverting input of the comparato).

9. The voltage generator arrangement as claimed in claim 1, wherein the voltage generator has a comparator, an output side of the voltage generator controlling a load transistor wherein the load transistor is connected between the first connection and the first output connection that is to be tapped off, wherein the first output connection is connected directly to an input connection of the comparator, and wherein the output of the impedance converter circuit is connected via a voltage divider to another input connection of the comparator.

10. The voltage generator arrangement as claimed in claim 2, wherein the charge pump circuit contacts the first reference ground potential line.

* * * * *